US007168881B2

(12) United States Patent
Hartlauer

(10) Patent No.: US 7,168,881 B2
(45) Date of Patent: Jan. 30, 2007

(54) MOVABLE BARRIER FOR PERIMETER PROTECTION

(76) Inventor: Walter H Hartlauer, 1221 W. Sienna Way, Taylorsville, UT (US) 84123

( * ) Notice: Subject to any disclaimer, the term of this patent is extended or adjusted under 35 U.S.C. 154(b) by 0 days.

(21) Appl. No.: 11/199,105

(22) Filed: Aug. 9, 2005

(65) Prior Publication Data

US 2006/0072966 A1 Apr. 6, 2006

Related U.S. Application Data

(60) Provisional application No. 60/615,163, filed on Oct. 1, 2004.

(51) Int. Cl.
*E01F 13/00* (2006.01)

(52) U.S. Cl. ..... 404/6

(58) Field of Classification Search ..... 404/6; 256/13.1

See application file for complete search history.

(56) References Cited

U.S. PATENT DOCUMENTS 3,391,620 A * 7/1968 Mahoney ..... 404/6
4,065,104 A * 12/1977 Pass ..... 256/13.1
4,632,598 A * 12/1986 Richards ..... 404/6
5,009,542 A * 4/1991 Hardin et al. ..... 404/6
5,181,794 A * 1/1993 Wilson et al. ..... 404/6
5,211,503 A * 5/1993 Quittner ..... 404/6
5,263,281 A * 11/1993 Osborn ..... 49/280
5,351,440 A * 10/1994 Vincent ..... 49/340
5,551,796 A * 9/1996 Anderson et al. ..... 404/6
6,832,870 B1 * 12/2004 Krivoy ..... 404/6

* cited by examiner

*Primary Examiner*—Gary S. Hartmann
(74) *Attorney, Agent, or Firm*—Brian C. Trask

(57) ABSTRACT

A movable barricade for use in controlling vehicle travel through a traffic control locus of a security perimeter, such as the fenced-in boundary often found around a building, a plant, an industrial area, or other infrastructure. Barricades structured according to certain aspects of the invention are capable of disabling forward progress of even large cargo-carrying vehicles, such as 18-wheeled trucks and trailers, or large-capacity tanker trucks. Preferred embodiments of the invention include a high-mass barrier element, such as a concrete Jersey Barricade, adapted to be rolled into a blocking position to obstruct the flow of traffic, and rolled into an open position to permit unobstructed flow of traffic though an access control point. Certain embodiments of the invention also provide control of pedestrian traffic through the locus.

14 Claims, 3 Drawing Sheets

MOVABLE BARRIER FOR PERIMETER PROTECTION

RELATED APPLICATIONS

This application claims the benefit under 35 U.S.C. 119(e) of the filing date of Provisional Application Ser. No. 60/615,163, filed Oct. 1, 2004, for "MOVABLE BARRIER".

BACKGROUND

1. Field of the Invention

The invention relates generally to gates, bridges, and movable barriers used to regulate vehicle and pedestrian traffic through a control locus. The invention particularly relates to barrier systems effective to disable even heavy transport vehicles that attempt to force entry through a controlled-access perimeter.

2. State of the Art

It is known to provide various forms of gates at control points of security perimeters to regulate traffic through a reduced number of entrances. Known gates include chain link fencing sections, wooden or metal cantilevered and raisable bars, and other generally light-weight obstruction devices. Such devices are typically light in weight to facilitate their operation, increase speed of actuation between open and closed positions, and to reduce associated wear and tear. Raisable bar type barriers are typically pivotally mounted at one end to permit their vertically pivoting removal from a blocking position. One known chain link gate is arranged for guillotine travel up and down. Often, a guard shack, or outbuilding is situated in proximity to the control locus to provide climate-controlled shelter to a person responsible for enforcing control of traffic at that location. Such known traffic-regulating arrangements can provide effective barriers to pedestrian access, but are insufficient to withstand an assault by determined individuals operating certain vehicles.

Rigorous control of access by vehicles to sensitive areas has become a significant problem in view of terrorist activities. One probable mode of attack by certain individuals desiring to cause damage to certain infrastructure includes using a loaded fuel-carrying tanker truck as a road-enabled bomb. Such vehicles are massive, and due to their inherent inertia, are difficult to force to a stop without the cooperation of the driver.

Various methodologies and devices have been employed in attempts to control travel of even large vehicles. Certain devices have been employed to control vehicle speed through a speed control area. Such devices include speed bumps and barriers placed to form a labyrinth path. Permanent speed bumps undesirably effect all traffic that passes over them, at all times. Therefore, smooth flow of traffic can sometimes be compromised. Speed bumps undesirably impose an annoyance on all drivers and passengers who travel over the speed control area. Speed bumps cause dirt, snow, and other debris carried by vehicles to fall from the vehicles as they pass over and are jostled by the bumps, thereby undesirably littering the area near the speed bumps. Furthermore, such bumps may suffer wear and tear from heavy vehicles, requiring excessive repair and maintenance.

The serpentine path required to negotiate a labyrinth path can be effective to reduce speed of a vehicle through a control area. In an effective labyrinth path, drivers are required to manipulate their vehicles through convolutions and sharp turns. Unavoidably, certain vehicles will fail to successfully negotiate one or more turns, running into portions of barriers, and causing unwanted damage to vehicles. In any event, speed control structures such as bumps and labyrinth paths do not provide a sure stopping capability to provide full control over vehicle access beyond a control point.

It is known to place physical barriers across a roadway to ensure vehicles come to a complete stop at a control point. Certain barriers are inadequate to force large vehicles to come to a stop. For example, a chain link fence gate is generally deemed too flimsy to significantly impede the forward progress of a heavy cargo-laden vehicle, such as a loaded tanker truck. Similarly, pivotally mounted, cantilevered bar-type obstructions, such as those lowered to block a highway at certain rail road crossings, also lack sufficient stopping power to impede progress of a vehicle driven by an uncooperative driver.

Massive barriers, such as certain barriers made from sections of concrete, are known as effective tools to resist forward progress of even large 18-wheel-type vehicles. One such concrete barrier is commonly known as a "Jersey Barricade", and has been placed in service in traffic situations throughout the United States for a sufficient amount of time to be generally recognized by many motorists, simply by its shape and overall appearance.

Conventionally, the Jersey Barricade is formed from molded concrete, and has a plain, unadorned, generally pyramidal cross-section. Sometimes, one or more loops of rebar are arranged to protrude from the top and may serve as pick-up points for a crane or other piece of heavy equipment to move the barricade. A typical use for such Jersey Barricades is in end-to-end alignment to form temporary lanes in which to confine vehicle travel near road construction sites. Such massive concrete barriers are effective to disable even large cargo-carrying vehicles that might attempt to travel through, rather than parallel to, a line of such barricades. However, a pedestrian can simply jump over a conventional Jersey Barricade.

A known method to place such Jersey Barricades includes tedious use of a forklift, crane, or other large piece of machinery to individually place sections of the barricade in a desired position. Such placement requires specialized machinery, which may not be available at certain locations at which it is desired to impose control of vehicle access. Placement of barrier sections one-at-a-time can undesirably consume a significant amount of time, and is inconvenient. Furthermore, when it is desired to permit vehicle progress beyond the control point, the barrier sections must be moved out of the way. Therefore, it would be an improvement to provide a more convenient barrier arrangement effective to reliably enforce control of vehicle access through a control locus. It would be a further improvement for the improved barrier to additionally provide control of pedestrian travel through the control locus.

BRIEF SUMMARY OF THE INVENTION

The present invention provides an apparatus for controlling flow of vehicular and pedestrian traffic through an entrance point, or control locus, of a controlled-access perimeter. Such controlled-access perimeter may include a length of fencing, wall, moat, or other traffic-resistant structure surrounding a facility, such as a building, refinery, or place of business. One or more traffic control loci may be established at selected locations spaced around such perimeter to permit selected traffic to pass through the perimeter.

Certain embodiments structured according to principles of the instant invention form a barrier effective to preclude driving a vehicle past the barrier without causing sufficient damage to the vehicle that the vehicle is rendered undrivable. One workable barrier includes a concrete wall weighing in excess of about 3,000 pounds. Sometimes, a fence portion can be associated with the barrier and adapted to increase resistance of the barrier to pedestrian traffic through the locus.

Typically, the barrier constitutes a portion of an extended security perimeter established around a facility, although "stand-alone" barriers may be used in certain situations. A currently preferred embodiment of the invention includes a wheeled barrier and a track system effective to support a wheel of the barrier. An exemplary barrier is sized to span substantially across a roadway at the control locus. Desirably, the barrier is sized such that at a blocking position the barrier is effective to resist flow of traffic through the control locus.

Certain embodiments structured according to principles of the instant invention also include a drive system operable to urge the barrier along the track system effective to move the barrier between an unblocking position (which can be defined as permitting substantially unimpeded passage of vehicle traffic past the control point), and the blocking position. Certain embodiments of the invention include a track system arranged automatically to urge the barrier into a blocking position in the event of a power failure, or outage, at the control locus.

An operable drive system may include a mechanized controller coupled to structure associated with the barrier and operable to urge movement of the barrier between the blocking position and the unblocking position. A currently preferred mechanized controller includes a commercially available slide gate controller with a pinch roller assembly. A cooperating barrier adapted to operate with such controller may include an extended drive plate coupled to the barrier and adapted to interface with the pinch roller assembly.

Certain other embodiments of the invention are adapted to be moved manually between open and closed positions. In such case, the barrier generally includes an interface adapted to receive manual input from a human effective to move the barrier from the blocking position to an unblocking position.

One currently preferred barrier includes a cavity in which to receive structure associated with one or more wheel adapted to facilitate movement of the barrier. Certain barriers are adapted, in harmony with a track system, for substantially horizontal and linear motion along a proscribed path between the blocking position and an unblocking position. Other barriers are adapted to permit pivoting motion of the barrier about a vertical axis effective to move the barrier between the blocking position and the unblocking position. In the case of pivoting barriers, a pivot structure is generally associated with a proximal end of the barrier as a fulcrum or axle about which the barrier may rotate. In such case, one or more transporting wheel is generally spaced apart from the pivot structure toward a distal end of the barrier. To facilitate movement of the barrier in an arc, the suspension axle for the transporting wheel desirably has an axis oriented substantially to pass through the pivot structure.

The invention can be embodied as an improved Jersey Barricade. In such case, the improvement typically includes one or more wheel associated with the Barricade effective to permit rolling movement of the improved Barricade, between a blocking position and an unblocking position, at a traffic control locus. Sometimes, a cavity is formed in the Barricade and configured and arranged to receive structure associated with the one or more wheel. Certain exemplary embodiments include a mechanized operator system adapted to urge the movement of an improved Barricade between open and closed positions. Certain improved Barricades are adapted for substantially linear motion along a proscribed path between a traffic blocking position and an unblocking position, which permits vehicles travel through the locus to be substantially unimpeded by the Barricade. Other Barricades are adapted for pivoting motion between the blocking position and the unblocking position.

In certain alternative embodiments, the invention can be embodied as a barrier structured to present a visual appearance including a Jersey Barricade to an approaching vehicle operator at a traffic control locus. For example, in some cases, it may be desirable to manufacture the Barricade to be light in weight, but still provide the visual appearance of massive, heavy truck-disabling, barrier. In any case, it often is desirable to associate a wheel with the improved barricade effective to permit rolling the barricade, between a blocking position and an unblocking position, at the traffic control locus. One embodiment within contemplation includes one or more cavity that may be filled on-site with heavy structure, such as concrete, rocks, bricks, and the like. Such a cavity reduces shipping weight of the barrier.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

As generally illustrated in FIGS. 1–13, the present invention provides an apparatus for temporarily obstructing a portion of a roadway 100 to resist transit of vehicles beyond a control point, generally indicated at 110, of a security perimeter. Preferred embodiments of the invention provide a movable barricade for use in controlling vehicle travel through a traffic control point or control locus of a security perimeter. Typically a security perimeter is defined by a fenced-in boundary around a building, a plant, an industrial area, or other infrastructure. Security perimeters can also be defined by other structures that are generally impassable to traffic of various kinds, including vehicle and pedestrian traffic. A roadway 100 may consist of a single lane, or may include a plurality of lanes for vehicle traffic. A barrier constructed according to principles of the instant invention will provide the visual appearance of an object through which even a heavy cargo vehicle cannot crash without sustaining such damage as to render the vehicle undrivable. Preferred embodiments will actually cause such damage.

Figure 1:
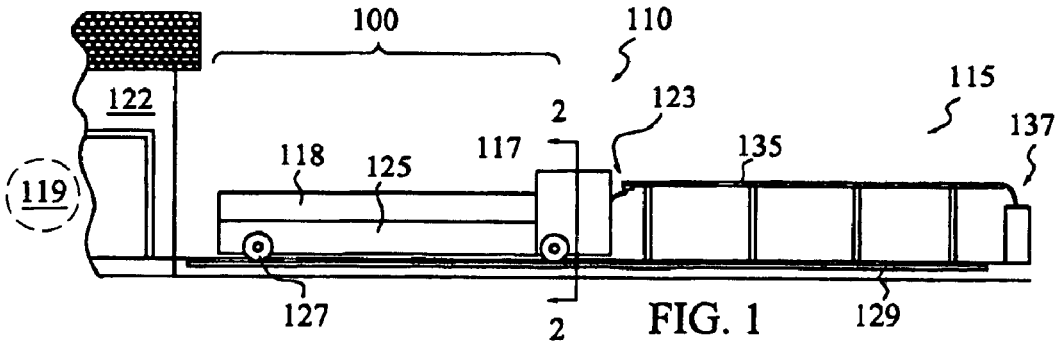
FIG. 1 is a front view in elevation of a first installed device constructed according to principles of the invention and disposed in a closed position to block a roadway.

With reference to FIG. 1, a first barrier system 115 constructed according to principles of the instant invention includes an associated drive mechanism located inside housing 117 and effective to cause motion of the barrier 118 from its blocking position (illustrated) to an open position that provides substantially unrestricted transit of vehicles through the control location 110. An operator control interface 119 configured to effect displacement of barrier gate element 118 may be disposed at any desirable and convenient location, such as inside a control shack or bunker 122. A workable operator control interface 119 nonexclusively includes one or more buttons, levers, or switches. In certain embodiments structured for manual movement of a barrier, an operator control interface can include a handle attached to, or even a surface of, structure associated with a barricade, such as barricade gate element 118.

In the embodiment illustrated in FIG. 1, a movable barrier 118 may be formed from one or more sections of pre-cast concrete carried for reciprocal motion on a trolley platform 125. The trolley platform 125 is typically supported by a plurality of wheels 127 for travel along a prescribed path, such as defined by track 129. Sometimes, a support foundation 130 is provided for the track 129. In other installations, the track may simply be supported on, or perhaps partially set into, the roadway 100. If present, a track operates to guide movement of the barrier 118 along a selected path, and generally provides a surface on which to reduce rolling resistance for wheels 127. In certain preferred embodiments, and as illustrated in FIG. 1, such selected path is disposed substantially transverse to the roadway at a vehicle access control point 110. It is within contemplation for a track to curve, or be otherwise shaped to accommodate deployment of a barricade 118 in a space adjoining the shoulder of the roadway 100, but having a reduced size compared to the width of the roadway.

Movement of a barrier 118 is typically accomplished by an associated drive mechanism. Currently preferred drive mechanisms include motorized assemblies operable to move a barrier between blocking and unblocking positions. However, in certain embodiments structured according to principles of the invention, barriers may be moved manually between blocking and open positions. One exemplary drive mechanism includes an electric drive motor. Of course, it is to be recognized that a drive motor can be embodied in other forms, such as an internal combustion engine powered by any operable fuel such as gasoline or diesel. Also, the drive motor may be disposed at any convenient location. For example a drive motor may be stationary, and coupled to structure operable to move the barrier.

Figure 2:
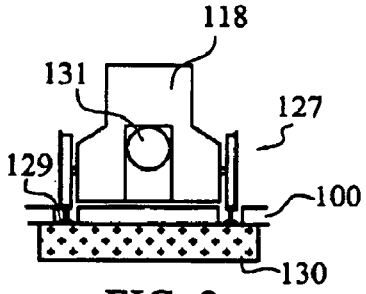
FIG. 2 is a cross-section side view in elevation through the movable barrier illustrated in FIG. 1, taken through section 2-2 and looking in the direction of the arrows.

With reference now to FIG. 1, it is currently preferred to provide an automated drive system to move barriers 118 between blocking and open positions. For example, a motor may be provided, such as inside a housing 117 or in any other convenient location, to drive one or more of wheels 127 or otherwise move the barrier 118 between blocking and open positions. In FIG. 2, the electric drive motor 131 carried by the barrier 118 is adapted to drive one or more wheels 127. As illustrated in FIG. 1, the motor 131 may receive electrical power through a coupling structure 133 carried for reciprocal motion along utility rail 135. The illustrated utility rail 135 receives its electrical power from the facility's electrical service 137. Alternative drive arrangements within contemplation include one or more stationary motors adapted to move barriers by way of various power transmission arrangements, including hydraulic drives, chain drives, screw drives, and mechanical drive arrangements such as rack-and-pinion assemblies, pinch rollers, and the like.

Desirably, a barrier constructed according to principles of the invention, such as barrier 118 in FIG. 1, is movable between an unblocking or open position, permitting unrestricted vehicle travel past-the control point, and a blocking position that effectively spans the roadway or otherwise resists vehicle travel past a control locus. A preferred barrier 118 constructed according to principles of the invention, and disposed in a blocking position, substantially precludes passage of vehicles beyond the control point without causing such damage to the vehicle as to render the vehicle undrivable.

Barriers within contemplation include any movable structure operable reliably to impose stopping control on large vehicles, such as fully loaded 18-wheeled cargo vehicles. Preferred barriers include objects having, or appearing to have, considerable mass. Operable materials of construction for a barrier include concrete, rock, metal, wood, composite materials, and combinations of materials. It is also within contemplation that a barrier may be constructed of alternative, light weight, material that is arranged to provide the appearance of a more massive structure.

One exemplary barrier 118 encompasses a structure known commercially as a Jersey Barrier. Such Jersey Barrier is typically formed from reinforced concrete that is cast in a mold having a generally pyramidal cross-section shape. A representative such barrier is sized about 2–3 feet in height, about 2 feet in width, about 12 or so feet in length, and weighs between about 4,000 and about 6,000 pounds. Of course, the form factor (cross-sectional appearance, length, internal reinforcing members, etc.) of a barrier, or section of a barrier, is irrelevant to operation of the invention, so long as the resulting structure is operable to substantially disable a vehicle that attempts to crash through the barrier. In general, barriers constructed according to principles of the instant invention include movable portions that weigh between several hundred pounds to over 20,000 pounds.

An operable barrier 118 may be fashioned as a unitary wall section of pre-cast concrete, including a commercially available Jersey Barrier. Desirably, reinforcement (such as by rebar) is provided internally to certain barriers 118 that are formed from cast concrete in accordance with known manufacturing practice. Such a unitary wall, or a plurality of wall sections, may be carried on a trolley, such as trolley platform 125 in FIGS. 1 and 3A.

Figure 3A:
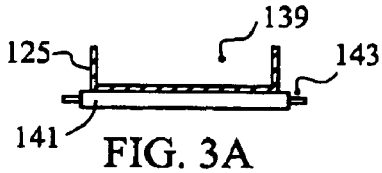
FIG. 3A is a cross-section side view in elevation of a trolley operable in the embodiment of FIG. 1.
Figure 3B:
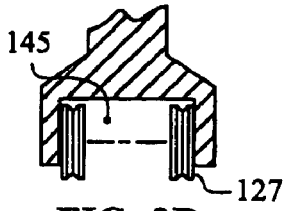
FIG. 3B is a cross-section side view in elevation through a portion of an alternative wheel mounting arrangement.

The trolley 125 illustrated in FIG. 3A includes an optional socket 139 in which to hold a barrier 118. The socket 139 can be sized to resist tipping of the barrier, if desired. The socket can also provide structure through which anchoring devices, such as bolts, may be inserted for reception in a barrier 118. Of course, a socket 139 is not required, and the barrier 118 can simply be placed on a flat trolley surface, or otherwise supported for reciprocal motion at a control locus 110.

It is further within contemplation that a socket 139 may be structured and arranged to receive a massive weight to be installed substantially on-site. One desirable socket 139 is configured to permit shipping a relatively low-weight barrier shell to an installation site, then pouring concrete into the socket 139 as a way to add a massive weight to the barrier. Other heavy items, such as rocks, bricks, and the like, may also, or alternatively, be used to add mass to a cavity 139. It is further within contemplation that a Jersey Barricade may be obtained from a source local to the installation site, and coupled to a wheel to form a barrier according to the instant invention.

A trolley axle 141 can be arranged to support the trolley 125, as illustrated in FIG. 3A. The axle 141 can include a wheel axle portion 143, as illustrated. However, other structural arrangements, not illustrated in detail, are operable to couple one or more wheels 127 to a trolley 125 or barricade 118. As one nonlimiting example, and effective to reduce manufacturing costs, a section of a barrier 118 may sometimes include one or more cast-in-place cavity 145 (see FIG. 3B), in which to carry wheels for transportation of the barrier 118 between blocking and unblocking positions. Such cavities 145 may include cast-in-place axles, or alternative axle structure may be fastened to the barrier subsequent to cure of the barrier's constituent material. Of course, it is also within contemplation to provide cast-in-place through-axles to provide wheeled support of a barrier having wheels mounted outboard of the barrier, such as in an arrangement similar to that illustrated in FIG. 4. Another nonlimiting example effective to provide wheeled barrier support includes bolt-on stub-axle fixtures that can be applied directly to an external surface of a barrier 118, such as to a vertical side surface.

It is within contemplation alternatively to provide a bolt-on modular trolley 125 section or short carriage assembly to provide one or more axle (and wheels) at discrete desired locations of a movable section of barrier 118. With reference to FIG. 3A, a trolley may extend a portion of the length of a barrier 118, or may extend substantially the full length, or farther. The trolley's trough 139 may be through-bolted at convenient locations to the barrier 118. An add-on portion (such as the housing 117 illustrated in FIG. 1), may carry a drive motor, controls, or gears, sprockets, and other assorted drive components. A plurality of partial-length trolleys may be provided to dispose one or more wheels 127 at one or more desired positions along the length of a barrier 118. In general, the number of axles and wheels provided may be determined by local requirements of each installation, and can be determined in consideration of total barrier weight, consequential bearing load distribution, composition of road surface, and other local factors.

A plurality of operable wheel and track arrangements are illustrated in FIGS. 4–8. In general, an operable wheel may be constructed from any material capable of supporting the wheel's portion of the weight of a barrier 118. It is currently preferred to use wheels made from metal, such as cast iron, or steel, to reduce the number of wheels required. It has been determined that metal wheels are sufficiently stiff that they produce a reduced amount of rolling friction, in combination with desirable track surfaces, thereby beneficially reducing difficulty of deployment of the barricade1 118. Alternative materials, including plastic, rubber, and combinations of materials are also workable to form wheels adapted to assist in moving a barrier. It is convenient to form the wheel's bearing surface to include a shape that is arranged to cooperate with a bearing surface of a guide track.

Figure 4:
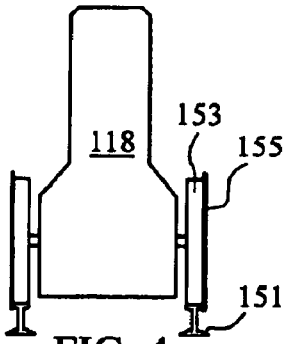
FIG. 4 is a cross-section side view in elevation illustrating a workable wheel and support interface.

FIG. 4 illustrates a guide track including a pair of rails 151 that are structured similar to rails of a railroad track. Wheels 153 are structured to cooperate with the tracks 151 to guide movement of a barrier 118. Illustrated wheel 153 includes a rim 155 configured to cooperate with its associated rail to guide motion of the barrier 118. It is within contemplation in an alternative wheel 153 to include a pair of rims 155 adapted to straddle a rail 151, or to straddle a portion of a guide rail having some other conformation.

Figure 5:
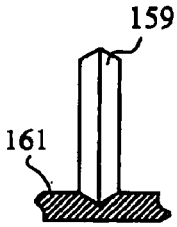
FIG. 5 illustrates an alternative wheel-support interface.
Figure 7:
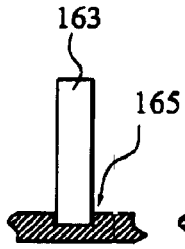
FIG. 7 illustrates an alternative wheel-support interface.
Figure 8:
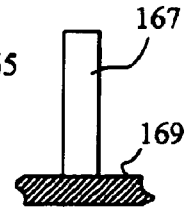
FIG. 8 illustrates an alternative wheel-support interface.

As illustrated in FIGS. 5, wheel 159 includes a v-shaped surface adapted for reception in a v-groove track structure 161. Such track structure 161 may be formed directly in a road surface, or may be provided to the road 100 (and, if required, to the storage position for a barricade in an open position), as an add-on structure. Similarly, the wheel 163 illustrated in FIG. 7 is adapted to cooperate with receiving structure generally indicated at 165. Receiving structure 165 operates to support the weight carried by wheel 163, and also guide a path of motion for the barrier 118. Sometimes, a wheel 167 associated with a barrier 118 is adapted to roll on an approximately flat support surface 169, as illustrated in FIG. 8. Support surface 169 may be a part of the road 100, or may be a support element added on top of such road 100. One such support surface 169 includes a stiff sheet, such as a metal plate, that can be anchored to the ground at a vehicle access control location. The stiff sheet 169 may carry structure operable to interface with and/or guide one or more wheels, or other transportation-assisting structure, associated with a barrier. It is to be realized that alternative support arrangements, including non-wheeled interfaces such as air bearings, are contemplated in certain alternative aspects of the invention.

Figure 6:
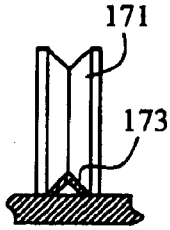
FIG. 6 illustrates an alternative wheel-support interface.

The wheel 171 and guide/support track 173 illustrated in FIG. 6 are representative of a currently preferred arrangement. A v-channel is included in wheel 171 in which to receive the track 173. An exemplary track 173 may be made from a length of angle iron that is placed with its spine in a vertical position, as illustrated. It is currently preferred to couple a pair of such tracks with a plurality of discrete and axially spaced-apart tie elements. Such tie elements may conveniently be formed from flat steel stock welded to the edges of the rails 173. It has been found that tie elements advantageously assist in maintaining the tracks 173 in a parallel installed position, and facilitate installation of the tracks 173. In an alternative embodiment, the rail elements 173 may be welded directly to a support plate 169 placed on a surface of roadway 100.

Figure 9:
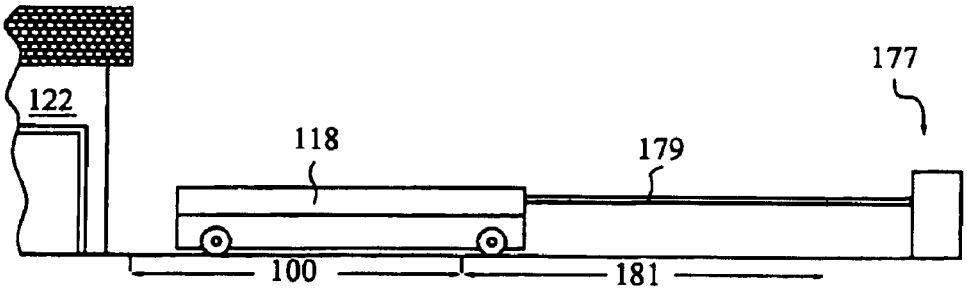
FIG. 9. is a front view in elevation of a second installed device constructed according to principles of the invention.

A stationary drive can be disposed at any convenient and operable location. For example, FIG. 9 illustrates a stationary drive 177 disposed substantially at a distant end of an unblocking position of the barrier. A drive element 179 couples the barrier 118 to the drive mechanism 177 operably to control motion of barrier 118 between a position to block roadway 100, and an open or unblocking position 181. Illustrated drive element 179 is a screw-drive element, and may be a ball screw, or other screw-type power transmission element.

Figure 10:
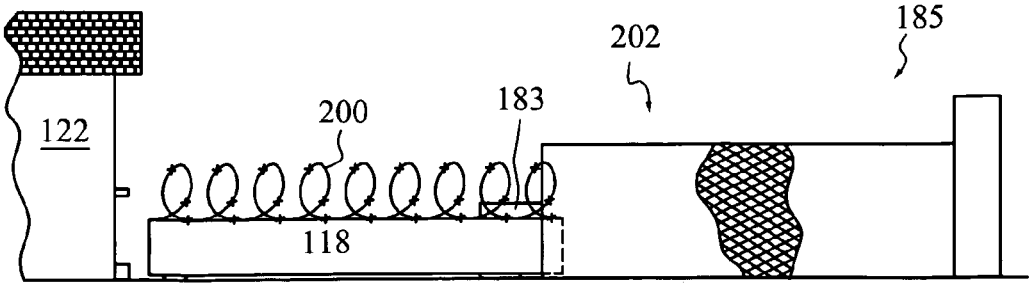
FIG. 10 is a front view in elevation of a currently preferred barrier arrangement.
Figure 11:
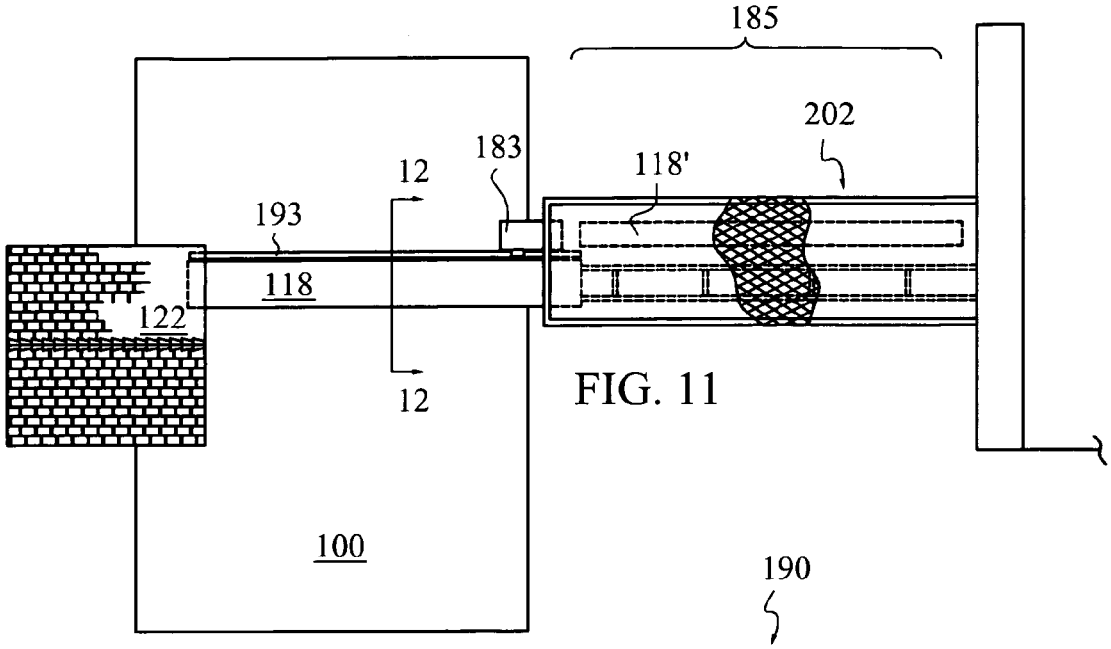
FIG. 11 is a top view looking down at a barrier arrangement similar to that illustrated in FIG. 10.
Figure 12:
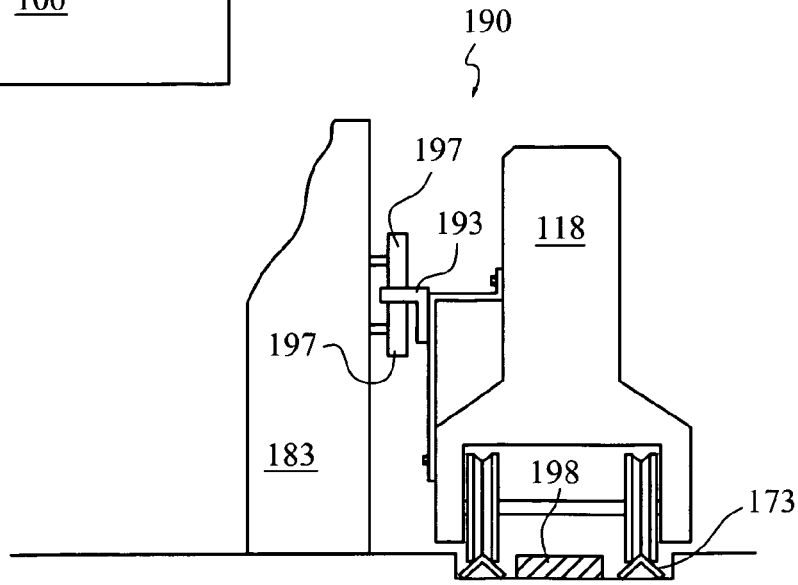
FIG. 12 is a cross-section view in elevation of the structure illustrated in FIG. 11, taken at section 12—12 and looking in the direction of the arrows.

In the alternative arrangements illustrated in FIGS. 10 and 11, the drive mechanism 183 is located near an edge of the roadway 100 (substantially at the edge between the roadway and the unblocking storage space generally indicated at 185). Of course, any other operable location would also be acceptable for a stationary drive in alternative workable embodiments of the invention.

In general, drive mechanisms or systems within contemplation and effective to move a barrier between blocking and unblocking positions include any operable power source and coupling structure. For example one operable drive system includes a drive motor arranged to drive wheels of the barrier directly. A second operable drive system includes a drive motor arranged to operate in harmony with other drive components. For example, the drive motor can be used to drive a pinion gear along a rack that is drivingly associated with a barrier. In another drive arrangement, the motor can be used to drive a sprocket to impart motion to a drive chain coupled to structure operable to move the barrier. It is further within contemplation for a drive motor to operate a screw drive, such as a ball screw arrangement. Hydraulicly powered drive arrangements are also within contemplation.

A currently preferred drive mechanism effective to horizontally roll a barrier between blocking and open positions includes a commercially available gate controller sold by the Hy-Security Company of Seattle, having a place of business in Washington and having a website located at http://www.hy-security.com. A model 222 EX or 222 X1-ST is currently preferred in combination with a wheeled Jersey Barricade weighing between about 3,000 and about 8,000 pounds. Such gate controller imparts an opening and closing speed of about one foot per second by way of a pinch roller assembly, such as the pinch roller assembly generally indicated at 190 in FIG. 12. Its cooperating barrier 118 includes an axially extended drive plate 193 adapted to couple with pinch rollers 197. Of course, an alternative controller can be selected in accordance with certain parameters of alternative barricades, such as barricade weight or its desired opening/closing speeds.

Desirably, the traffic control system of the instant invention is arranged for installation at a vehicle control point without causing significant disruption in vehicle access during the installation process. Furthermore, it is often desirable for any installed tracks, such as preferred tracks 173 illustrated in FIGS. 6 and 12, to be arranged in an installed position to minimize their impact on vehicles rolling over the tracks. For example, guide tracks desirably are arranged to protrude from the surface of the roadway 100 by a minimal or tolerable amount, if at all, to reduce a "bump" that inherently causes dirt, snow, or other debris attached to vehicles, to fall onto the road at the control locus. It is generally desirable to minimize such "bump" to reduce clean-up requirements at the control locus area. In certain installations, a spacer 198 may be installed in a trough or groove between tracks, to help reduce perceptible irregularity in the road surface.

Sometimes, to improve a barricade's resistance to pedestrian traffic, a fence may be added to the barricade structure. In certain cases, a fence 200 adds a visually imposing appearance to a barricade, which may serve to intimidate potential gate-crashers. An operable fence addition may include a section of barbed wire of some type, such as the coiled razor wire illustrated in FIG. 10. Alternative fencing 200 which may sometimes be added to a barricade includes sections of chain link fencing, wood slats, horizontal stretches of barbed wire, or fencing having other known construction.

As illustrated in FIGS. 10 and 11, sometimes it is desirable to provide safety containment, generally indicated at 202, for a barricade at an unblocking storage space 185. Typically, safety fencing is arranged to reduce access to human traffic to an area that could be a pinch point as the barricade 118 is moved from a blocking position to the open position 181. The safety containment 202 also may serve as a deterrent to vandals to resist damage to the barrier assembly. As illustrated, one preferred configuration for such safety containment 202 provides a fenced volume sized to receive a barrier for rolling deployment from one end.

Furthermore, the safety containment can operate as an extension of the barrier assembly to improve traffic control at the control locus. The safety containment can operate to fill in, or "harden" a gap in the controlled security perimeter established about a facility. In certain cases, a second back-up barrier 118', or other vehicle-damaging structure, may be included in the safety containment arrangement 202 to resist a vehicle that attempts to avoid main barricade 118 by crashing though an unreinforced fence section. Back-up barrier 118' may include a substantially identical second barrier 118, or may be any other structure resistant to vehicle travel. A workable back-up barrier includes one or more Jersey Barricade.

Figure 13:
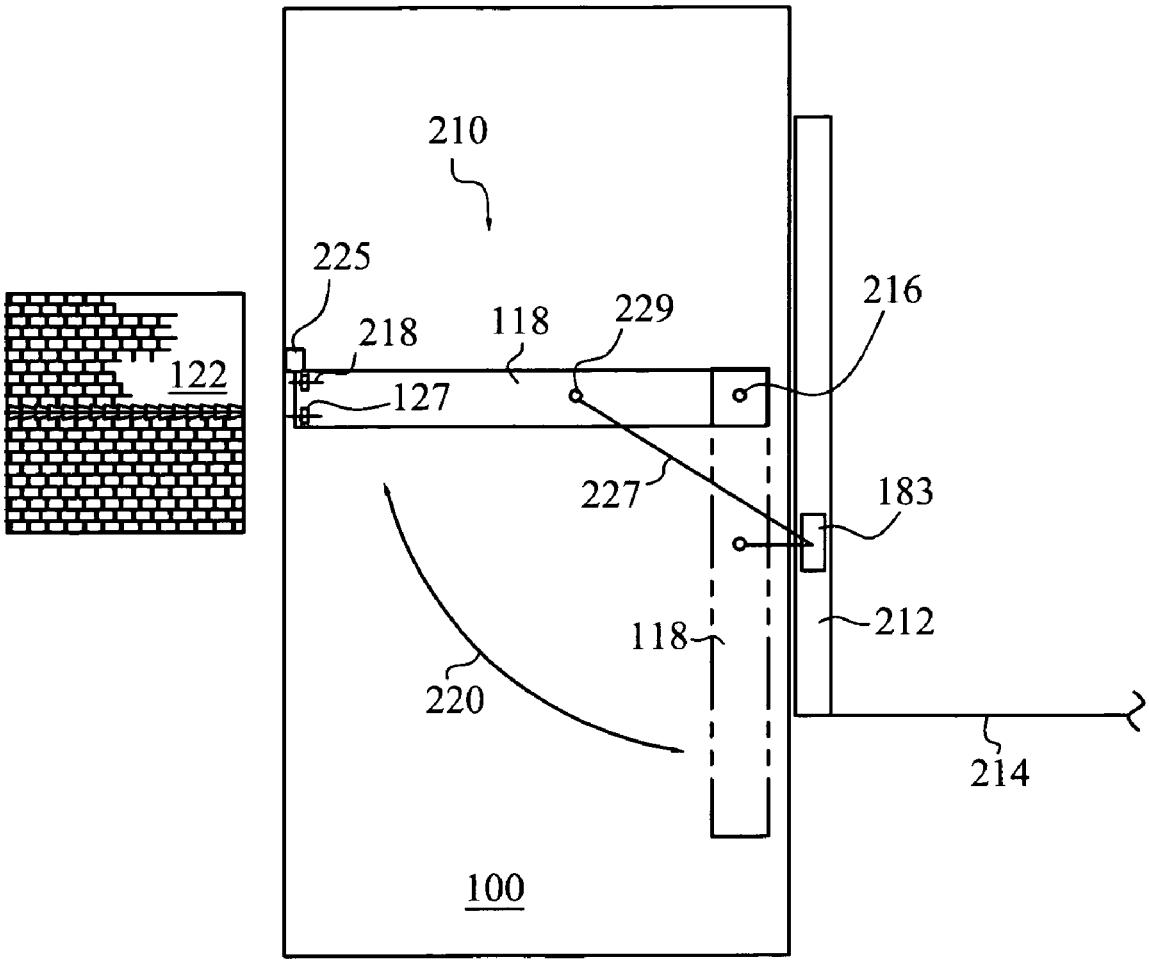
FIG. 13 is a top view looking down at another currently preferred barrier that is arranged for pivotal movement between blocking and open positions.

As illustrated in FIG. 13, certain gate areas have limited space to the side of a roadway 100, and therefore cannot accommodate a movable barrier 118 adapted for substantially linear transversely horizontal rolling deployment. A workable barrier system, generally indicated at 210, for such gate areas and constructed according to principles of the invention, includes the pivotally mounted barricade 118 illustrated in FIG. 13. The illustrated pivoting gate arrangement 210 permits a gate element 118 to be disposed between blocking and open positions substantially within the space provided by the roadway 100 itself. Systems similar to pivoting system 210 may also be used to advantage in other situations where insufficient room is available for a transversely deployed barrier system 115 between edge boundary structure 212 of the perimeter control fence 214, and structure disposed on an opposite side of the roadway 100, such as guard shack 122.

A pivoting barrier 118 desirably includes transporting structure, such as one or more wheel 127, and pivot structure 216. In general, pivot structure 216 is operable to provide a vertical axis about which a proximal end of the barrier gate element 118 rotates. Barricade gate elements 118 configured for pivotal deployment may be structured similarly to barricades 118 configured for transverse rolling deployment. In both cases, certain preferred pivoting barriers include one or more massive component, such as a concrete wall, adapted to disable vehicles that attempt to crash through the deployed barrier. A Jersey Barricade can be modified to make an exemplary pivoting barrier 118 by inclusion of one or more distally mounted wheel and proximally disposed pivot structure.

With reference still to FIG. 13, the barricade 118 is mounted at proximal pivot structure 216 for pivoting displacement between a blocking position (solid line position) and an unblocking position (phantom line position). Preferably, a distal wheel 127 is mounted on an axle 218 associated with the barrier 118 to orient the wheel 127 such that wheel 127 can easily follow arcuate path 220. One way to orient the wheel 127 is for an axis of the wheel's axle to be oriented substantially to pass through pivot structure 216, as illustrated. In certain embodiments of pivoting systems 210, a blocking structure 225 may be included as a positive stop to resist overtravel of the distal end of gate 118.

In certain embodiments structured according to the invention, pivoting gate 118 may be opened and closed manually.

However, it is typically preferred to provide a gate controller 183 associated with gate element 118 through linkage 227 and operable to urge the barricade between open and closed positions. It is further preferred that the pivoting barricade system 210 include an operator control interface 119 structured for deployment of gate element 118 by an operator disposed at a location remote from the gate. Linkage element 227 may be embodied as an extendable arm pivotally affixed to gate 118 at knuckle 229. Drive arrangements other than illustrated are within contemplation, including adaptations of drive arrangements suitable for transversely rolling barricade elements. Furthermore, alternative workable drive systems nonexclusively include: a direct drive associated with pivot structure 216, a gravity-operated or assisted track arrangement, cables, multi-armed linkage, and other known driving assemblies.

While the invention has been described in particular with reference to certain illustrated embodiments, such is not intended to limit the scope of the invention. The present invention may be embodied in other specific forms without departing from its spirit or essential characteristics. The scope of the invention is, therefore, indicated by the appended claims. All changes which come within the meaning and range of equivalency of the claims are to be embraced within their scope.

What is claimed is:

1. An apparatus to restrict vehicle travel through a control locus associated with a roadway, the apparatus comprising:

a wheeled Jersey barrier formed from concrete and sized such that at a blocking position said Jersey barrier is effective to preclude passage thereby of a fully loaded 18-wheeled cargo vehicle without causing sufficient damage to said vehicle that said vehicle is rendered undrivable; and a track system disposed substantially in the plane of the roadway and structured to support a wheel of said Jersey barrier for reciprocal travel of said wheel by rolling on said track to facilitate moving said Jersey barrier between said blocking position and an unblocking position.

2. The apparatus according to claim 1, further comprising:

a drive system operable to urge said Jersey barrier along said track system effective to move said Jersey barrier between said unblocking position, permitting substantially unimpeded passage of vehicle traffic past said control locus, and said blocking position.

3. The apparatus according to claim 1, wherein:

said Jersey barrier is sized to span substantially across said roadway at said control locus.

4. The apparatus according to claim 1, wherein:

said Jersey barrier is adapted to comprise a portion of a security perimeter established around a facility; and said track system is adapted to automatically urge said Jersey barrier toward a blocking position in the event of a loss of power at said control locus.

5. The apparatus according to claim 2, wherein:

said drive system comprises a mechanized controller coupled to structure associated with said Jersey barrier and operable to urge movement of said Jersey barrier between said blocking position and said unblocking position.

6. The apparatus according to claim 2, wherein:

said mechanized controller comprises a pinch roller assembly.

7. The apparatus according to claim 6, further comprising:

an extended drive plate coupled to said Jersey barrier and adapted to interface with, for driving by, said pinch roller assembly.

8. The apparatus according to claim 1, wherein:

said Jersey barrier comprises a cavity configured and arranged as a mold for filling with a quantity of concrete slurry in an amount in excess of 2,000 pounds to permit adding a massive weight to the barrier at an installation site.

9. The apparatus according to claim 1, wherein:

said Jersey barrier comprises a concrete wall weighing in excess of 3,000 pounds.

10. The apparatus according to claim 1, further comprising:

a fence portion associated with said Jersey barrier and adapted to increase resistance of said Jersey barrier to pedestrian traffic through said locus.

11. The apparatus according to claim 1, wherein:

said Jersey barrier further comprises a cavity configured and arranged in which to receive structure associated with said wheel such that said wheel is substantially contained inside said Jersey barrier effective to reduce visibility of said wheel to oncoming traffic.

12. The apparatus according to claim 1, wherein:

said Jersey barrier is adapted, in harmony with said track system, for substantially linear motion as said wheel rolls along a proscribed path between said blocking position and an unblocking position.

13. The apparatus according to claim 1, wherein:

said Jersey barrier is adapted, in harmony with said track system, for pivoting motion of said Jersey barrier about a substantially vertical axis effective to swing said Jersey barrier, in a substantially horizontal plane, between said blocking position and an unblocking position.

14. The apparatus according to claim 13, further comprising:

pivot structure associated with a proximal end of said Jersey barrier and comprising a vertically disposed pivot axis;

said wheel being spaced apart from said pivot structure toward a distal end of said Jersey barrier; and a suspension axle for said wheel having a substantially horizontal axis of rotation, said horizontal axis of rotation being oriented substantially to pass through said pivot axis to permit rotation of said Jersey barrier about said pivot axis effective to swing said Jersey barrier between said blocking position and said unblocking position.

* * * * *